US005651347A

United States Patent [19]

Oi et al.

[11] Patent Number: 5,651,347

[45] Date of Patent: Jul. 29, 1997

[54] FUEL SUPPLY APPARATUS FOR INTERNAL COMBUSTION ENGINE

[75] Inventors: Kiyotoshi Oi, Toyohashi; Kazuji Minagawa, Tokoname; Masao Yonekawa, Kariya, all of Japan

[73] Assignee: Nippondenso Co., Ltd., Kariya, Japan

[21] Appl. No.: 654,269

[22] Filed: May 28, 1996

[30] Foreign Application Priority Data

May 30, 1995 [JP] Japan ..... 7-132349

[51] Int. Cl.[6] ..... F02M 37/04

[52] U.S. Cl. ..... 123/497; 123/516; 123/179.17

[58] Field of Search ..... 123/497, 516, 123/510, 506, 467, 179.17

[56] References Cited

U.S. PATENT DOCUMENTS

| | | | |
|---|---|---|---|
| 3,742,256 | 6/1973 | Frederiksen | 123/497 |
| 5,148,792 | 9/1992 | Tuckey . | |
| 5,263,459 | 11/1993 | Talaski | 123/516 |
| 5,293,299 | 3/1994 | Iwabuchi | 123/497 |
| 5,327,872 | 7/1994 | Morikawa | 123/516 |
| 5,398,655 | 3/1995 | Tuckey . | |
| 5,425,342 | 6/1995 | Ariga | 123/516 |
| 5,477,829 | 12/1995 | Hassinger | 123/467 |
| 5,582,510 | 12/1996 | Dobler | 123/497 |

FOREIGN PATENT DOCUMENTS

| | | | |
|---|---|---|---|
| 0200663 | 12/1982 | Japan | 123/516 |
| 58-8265 | 1/1983 | Japan . | |
| 6048768 | 3/1983 | Japan | 123/516 |
| 6-272632 | 9/1994 | Japan . | |
| 7-103097 | 4/1995 | Japan . | |

*Primary Examiner*—Carl S. Miller
*Attorney, Agent, or Firm*—Nixon & Vanderhye P.C.

[57] ABSTRACT

According to the present invention, a fuel supply apparatus includes a fuel pump, a delivery pipe to distribute the fuel to each injector of the engine by receiving fuel supply by the fuel pump, a pressure sensor to detect the fuel pressure supplied to the delivery pipe, and a check valve disposed in the fuel discharge pipe of the fuel pump to prevent counterflow of the fuel from the delivery pipe. The amount of fuel discharged from the fuel pump is controlled to maintain the fuel pressure in the delivery pipe at a set value during fuel injection. At the stop of the engine, the amount of fuel discharged from the fuel pump is substantially reduced to zero, and the pressure of the fuel from the fuel pump is gradually reduced. After the pressure of the fuel discharged from the fuel pump reaches a predetermined value, the fuel pump stops. In this way the internal pressure of the delivery pipe is prevented from excessively rising without exterior parts such as a relief valve disposed outside of the fuel pump.

20 Claims, 8 Drawing Sheets

FUEL SUPPLY APPARATUS FOR INTERNAL COMBUSTION ENGINE

CROSS REFERENCE TO RELATED APPLICATION

This application is based upon and claims priority of Japanese Patent Application No. Hei. 7-132349 filed on May 30, 1995, the content of which is incorporated herein by reference.

BACKGROUND OF THE INVENTION

1. Field of the Invention

The present invention relates to a fuel supply apparatus for an internal combustion engine, especially to an improved structure of the fuel supply apparatus to maintain supplied fuel pressure at a set value by detecting the fuel pressure supplied to a delivery pipe with a pressure sensor and by adjusting a fuel discharge amount of a fuel pump.

2. Description of Related Art

FIG. 10 shows a conventional fuel supply apparatus for an internal combustion engine with a delivery pipe. A fuel supply pipe 22 extending from a fuel pump 1 disposed in a fuel tank 7 is connected to a delivery pipe 2 through a filter 23. Plural fuel injection valves (injectors) 21 disposed corresponding to each cylinder of an engine (not shown) are. connected to the side wall of delivery pipe 2.

A discharge amount of the fuel (rotational speed) of fuel pump 1 in this case is fixed. When a supplied fuel amount of injectors 21 changes according to a running condition of a vehicle, the internal pressure in delivery pipe 2 varies. Since the change of the fuel pressure in delivery pipe 2 causes fluctuation of an injection amount of injectors 21, a pressure regulating valve 24 is disposed in delivery pipe 2 as shown in the figure to maintain the fuel pressure in delivery pipe 2 at a constant value.

When pressure regulating valve 24 is disposed, however, a return pipe 25 for returning the fuel to fuel tank 7 is also needed, thus requiring a piping space in the engine compartment and a work for connecting the pipe. Furthermore, since pressure regulating valve 24 is disposed in delivery pipe 2, the fuel receiving heat from the engine returns to fuel tank 7, and a large amount of evaporated fuel is generated in fuel tank 7.

In light of the above-described problems, in a fuel supply apparatus as disclosed in JP-A-6-50230, a manifold with a built-in pressure sensor is disposed at the outlet of the fuel supply pipe in the fuel tank to maintain the fuel pressure, detected by the pressure sensor and supplied to the delivery pipe, at a constant value by controlling the rotational speed of the fuel pump. In this structure, the aforementioned pressure regulating valve for maintaining the internal pressure of the delivery pipe at the constant value and a piping for the valve are not needed.

In the fuel supply apparatus disclosed in the above-described publication, however, since the pressure regulating valve of the delivery pipe is eliminated, the delivery pipe is closed when fuel injection stops, e.g., the internal combustion engine is stops or fuel is cut off. Thus, the fuel in the delivery pipe receives residual heat of the engine to thereby raise the temperature. Accordingly, when the fuel is expanded in its volume or vaporized in the delivery pipe, there causes a problem that the internal pressure becomes abnormally high.

To solve this problem, a relief valve may be disposed at the downstream side of the check valve in the manifold to restrain the internal pressure of the delivery pipe from rising. In this case, the structure of the manifold with the built-in pressure sensor becomes so complicated that it is more difficult to manufacture the manifold.

SUMMARY OF THE INVENTION

An object of the present invention is to provide a fuel supply apparatus for an internal combustion engine without using exterior parts such as a relief valve and the like disposed in the fuel supply pipe outside a fuel pump to simplify the entire structure of the fuel supply apparatus.

Another object of the present invention is to provide a fuel supply apparatus for an internal combustion engine capable of preventing the pressure of supplied pressure from increasing excessively.

According to the present invention, the amount of fuel discharged from the fuel pump is controlled to maintain the fuel pressure supplied to the fuel injection valve at a set value during the fuel supply to the engine. At the stop of the engine, the amount of fuel from the fuel pump is substantially reduced to zero, and the pressure of the fuel from the fuel pump is gradually reduced. After the pressure of the fuel discharged from the fuel pump reaches a predetermined value, the fuel pump stops, and the check valve closes due to counterflow of the fuel caused by a rapid decrease of the pressure of the fuel discharged from the fuel pump. Accordingly, supplied fuel pressure is maintained at the predetermined value. In this condition, when remaining fuel expands in its volume or is vaporized due to residual heat of the combustion engine, the internal pressure in the fuel supply passage rises. However, since the supplied fuel pressure before being increased is lower than that while the internal combustion engine is running, the internal pressure in the fuel supply passage is prevented from being excessively high.

The internal pressure in the fuel supply passage after the reduction of the pressure is maintained at the predetermined value which is not zero, so that the generation of evaporative fuel can be restricted to the minimum.

According to the present invention, exterior parts such as a relief valve and the like disposed outside the fuel pump are not required, thereby simplifying the entire structure of the apparatus.

When the voltage applied to the fuel pump is reduced at a fixed rate from a voltage value just before the internal combustion engine stops, both discharged amount and pressure of the pump can be easily adjusted.

When the responsive movement of the check valve is delayed at the stop of the fuel supply to the engine, the pressure of the fuel supplied to the fuel injection valve is gradually reduced to the predetermined value, because counterflow of the fuel passes while the check valve is opened.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

The preferred embodiments of the present invention are hereinafter described with reference to the accompanying drawings.

Figure 1:
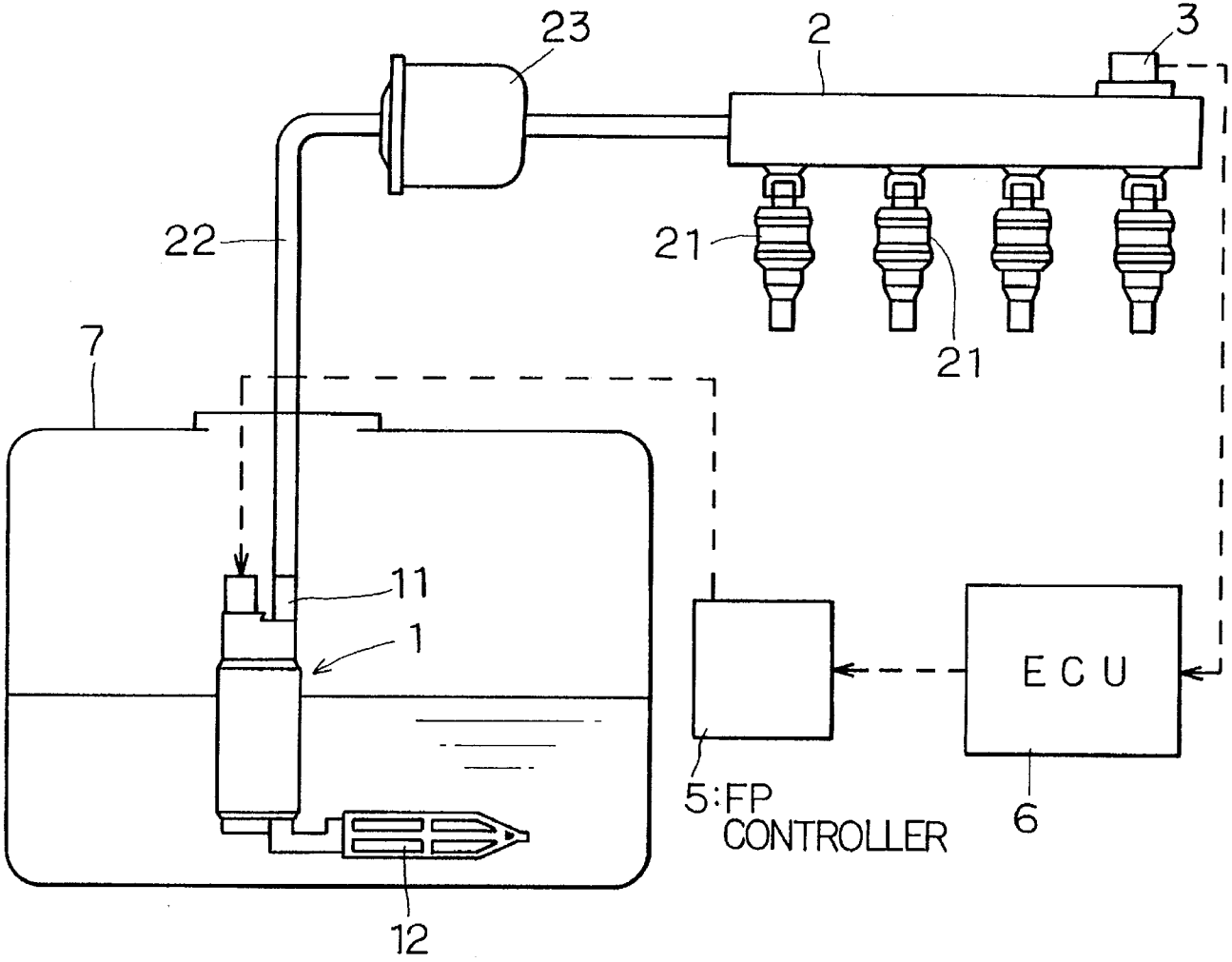
FIG. 1 is a view of an entire structure of a fuel supply apparatus according to a first embodiment of the present invention.

A first embodiment of the present invention is described with FIG. 1 showing an entire structure of a fuel supply apparatus. A fuel supply pipe 22 extends upward from a discharge pipe 11 at the top end surface of a fuel pump 1 disposed perpendicularly in a fuel tank 7 so as to pass through the tank wall and leads to a delivery pipe 2 through a filter 23. Plural fuel injection valves (injectors) 21 disposed corresponding to each cylinder of an engine (not shown) are connected to the side wall of delivery pipe 2. Fuel in fuel tank 7 is sucked into fuel pump 7 from the inlet pipe at the lower part of fuel pump 7 through a filter 12 and is pressurized and discharged to discharge pipe 11.

A pressure sensor 3 is disposed at the side wall of the end of delivery pipe 2 for detecting fuel pressure "Pf" therein and its output signal is input to an electronic control unit (ECU) 6. A command signal is output from ECU 6 to a fuel pump (FP) controller 5 to control the fuel pressure Pf to a set value. FP controller 5 changes revolution speed, i.e., fuel discharging amount of fuel pump 1 according to the command signal.

Figure 2:
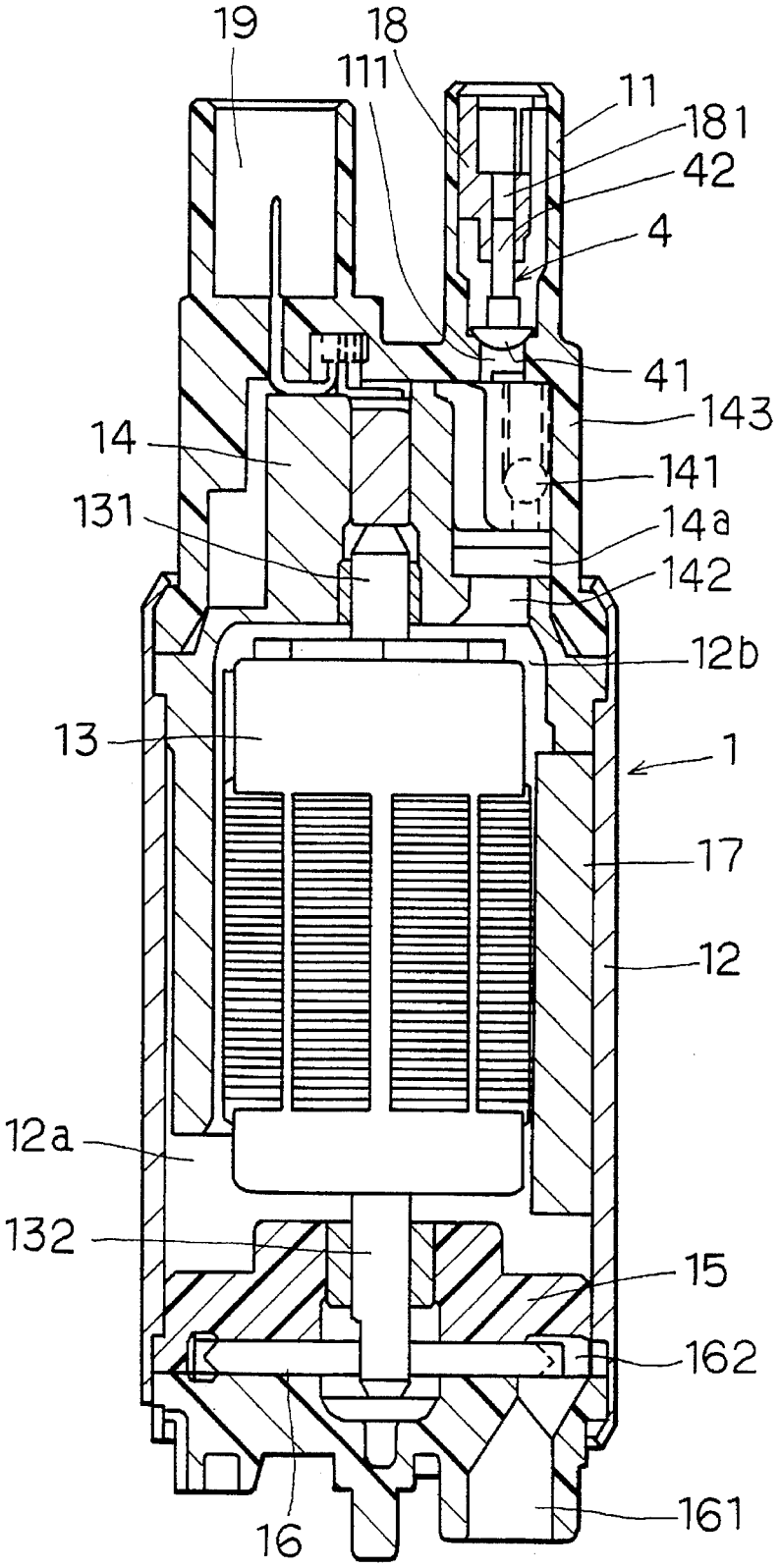
FIG. 2 is a entire cross-sectional view of a fuel pump as a whole according to the first embodiment of the present invention.

FIG. 2 shows a structure of fuel pump 1 in detail. a motor rotor 13 is located at the center of a cylindrical pump housing 12 and is rotatably supported by shafts 131 and 132 protruding upward and downward on partition walls 14 and 15 in pump housing 12. An impeller 16 is disposed at the lower shaft 132 of motor rotor 13. After the fuel sucked by rotating impeller 16 through an inlet port 161 is compressed and pressurized in pump 162, the fuel is delivered to a space **12*a* in housing 12** from a discharge port (not shown in the figure).

The fuel delivered to a space **12*a* in housing 12 passes upward through the clearance between motor rotor 13 and a motor stator 17 disposed around motor rotor 13 and flows from a space 12*b* in housing 12 to an opening 142 of partition wall 14 so as to open check valve 4 disposed in discharge pipe 11** and further flows upward.

The lower valve portion 41 of check valve 4 is in the shape of an umbrella having a large diameter and the spherical tip end of valve portion 41 contacts with an upper edge stepped portion of discharge opening 111 to thereby close it. A bar-shaped base 42 of check valve 4 inserted into a through hole 181 of a support member 18 disposed in delivery pipe 11 moves upward and downward while receiving a certain sliding resistance. When pump 162 discharges the fuel after motor rotor 13 is rotated, valve portion 41 of check valve 4 receives the discharge pressure, so that check valve 4 rises so as to open opening 111.

The discharge amount of the fuel can be changed by supplying a driving pulse signal of a predetermined duty with the coil of motor rotor 13 through electric supply connector 19 disposed at the top end portion of pump housing 12 and by changing the rotational speed of impeller 16 (motor rotor 13).

A relief passage where a relief valve 141 is disposed is open to a space **14*a* between partition wall 14 and an end frame 143**.

Figure 3:
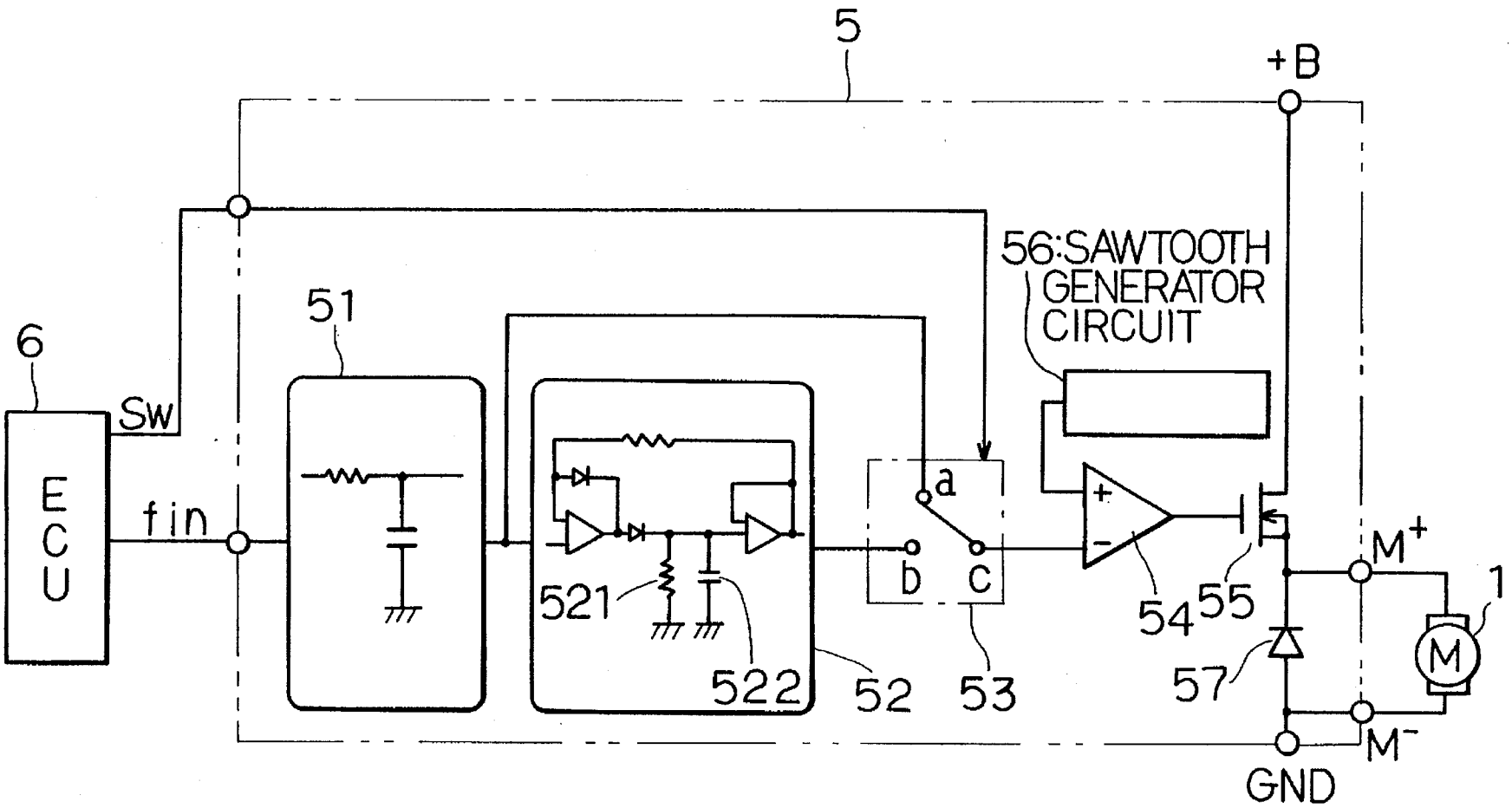
FIG. 3 is a circuit diagram of an FP controller according to the first embodiment of the present invention.

FIG. 3 shows a detail of FP controller 5 which includes a duty/analog (D/A) converting circuit 51 connected in series, a peak hold circuit 52, a switch circuit 53, a comparator 54, a driving transistor 55 of p-channel FET and the like. D/A converting circuit 51 is an integrating circuit composed of a resistor and a condenser shown in the figure. Peak hold circuit 52 has a resistor 521 connected in parallel with a condenser 522, and its output voltage gradually decreases from the peak hold value based on time constant of resistor 521 and condenser 522.

An output pulse signal "fin" of ECU 6 is input to D/A converting circuit 51. Switch circuit 53 selectively connects D/A converting circuit 51 or peak hold circuit 52 with comparator 52 according to the switching command signal SW separately output by ECU 6. Output pulse signal fin has a duty ratio in accordance with operation volume at the time to compare an output signal by pressure sensor (in FIG. 1) with a set pressure value in ECU 6.

An output by switch circuit 53 is input to the inverting input terminal of comparator 54 while sawtooth wave output by a sawtooth generator circuit 56 is input to the non-inverting input terminal of comparator 54. Fuel pump 1 connected to driving transistor 55 in parallel with a diode 57 applies driving voltage to transistor 55, when transistor 55 is connected.

When the engine is running, the contact points "a" and "c" of switch circuit 53 in the figure are electrically connected to directly connect D/A converting circuit 51 to comparator 54. When the fuel injection amount (fuel consumption amount) by injector 21 increases and fuel pressure "Pf" inside delivery pipe 2 decreases below a set value "Ps", the high-level duty of output pulse signal "fin" increases and the output voltage of D/A converting circuit 51 increases. Thus, after comparing the output voltage of D/A converting circuit 51 with sawtooth wave, the low-level duty of the output in comparator 54 increases and the conducting duty of driving transistor 55 increases, thus increasing a voltage applied to fuel pump 1 and increasing the rotational speed of fuel pump 1. Consequently, the fuel discharge amount increases, and the fuel pressure "Pf" in delivery pipe 2 rises.

On the other hand, when the fuel consumption amount decreases and the fuel pressure "Pf" in delivery pipe 2 exceeds set value "Ps", the high-level duty of output pulse signal "fin" decreases and the output voltage of D/A converting circuit 51 is reduced. Thus, the low-level duty of output in comparator 54 decreases and the conducting duty of driving transistor 55 is reduced. Consequently, the rotational speed of fuel pump 1 decreases, the discharge amount is reduced, and the fuel pressure "Pf" in delivery pipe 2 decreases.

Fuel pressure Pf inside delivery pipe 2 can be maintained at a set value in the above-described manner.

In the idling condition immediately before the engine stops, fuel consumption amount is extremely small and fuel pump 1 maintains a desired fuel pressure "Pf" (for example, 250 KPa) at a relatively low rotational speed. When the engine stops in this condition, ECU 6 adjusts the high-level duty of output pulse signal "fin" to zero. Thus, the output voltage of D/A converting circuit 51 becomes 0 V.

Figure 4A:
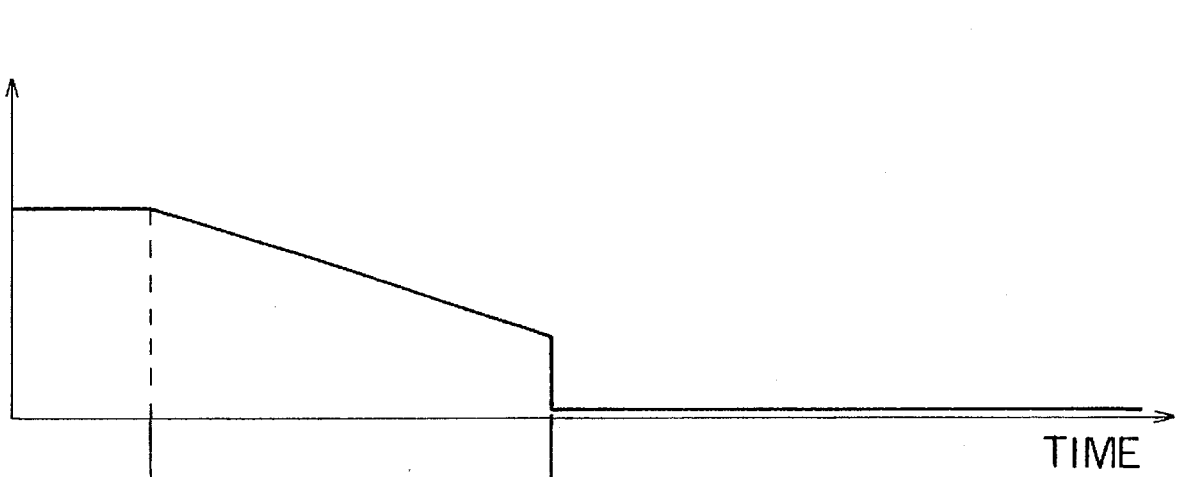
FIG. 4A is a graph showing a change of voltage applied to the fuel pump with respect to time and FIG. 4B is a graph showing a change of fuel pressure inside a delivery pipe with respect to time according to the first embodiment of the present invention.

When contact points "c" and "b" in switch circuit 53 are simultaneously switched to be connected to each other based on switching signal "SW" from ECU 6, an output from peak hold circuit 52 decreasing at a predetermined time constant from the voltage value just before the engine stop is input to comparator 54 so as to reduce the conducting duty of driving transistor 55. Consequently, the average voltage applied to fuel pump 1 gradually decreases, and accordingly its rotational speed is gradually reduced (in "B" range in FIG. 4A).

During that time, the amount of discharged fuel from fuel pump 1 substantially becomes zero and only the discharge pressure gradually decreases accompanied with lower rotational speed of fuel pump 1. Discharge pressure of fuel pump 1 decreases so moderately that counterflow is not caused substantially, and therefore, check valve 4 stops and keeps an open condition. In this condition, when discharge pressure of fuel pump 1 decreases according to a decrease in the rotational speed of fuel pump 1 as described above, fuel pressure "Pf" in delivery pipe 2 gradually decreases (in "B" range in FIG. 4B).

When fuel pressure "Pf" in delivery pipe 2 reaches the lowest limit value "PL", ECU 6 after receiving an output signal of pressure sensor 3 switches switch circuit 53 to connect contact point "c" to contact point "a" again. Thus, the output voltage of 0 V of D/A converting circuit 51 is input to comparator 54 and its output keeps a high level constantly to thereby disconnect driving transistor 55. As a result, voltage applied to fuel pump 1 becomes 0 V to stop the rotational speed of fuel pump 1 (in "C" range in FIG. 4A).

Since the discharge pressure of the fuel rapidly decreases to zero when fuel pump 1 stops, check valve 4 closes discharge opening 111 due to counterflow of the fuel. Accordingly, the fuel pressure in delivery pipe 2 is maintained at a slightly lower pressure than the lowest limit value "PL" (in "C" range in FIG. 4B). When fuel temperature in delivery pipe 2 receiving residual heat of the engine increases in this condition, fuel pressure Pf in delivery pipe 2 rises as shown in the figure, because the fuel expands in its volume or partially vaporized. However, since fuel pressure "Pf" in delivery pipe 2 is restrained to a low value close to the lowest limit value "PL", even if fuel pressure "Pf" rises, the fuel pressure "Pf" will not exceed a set value "Ps" while the engine is running. The fuel pressure "Pf" in delivery pipe 2 is prevented from being reduced to zero, because it is difficult to restart up the engine due to the accelerated evaporation of the fuel.

Figure 4B:
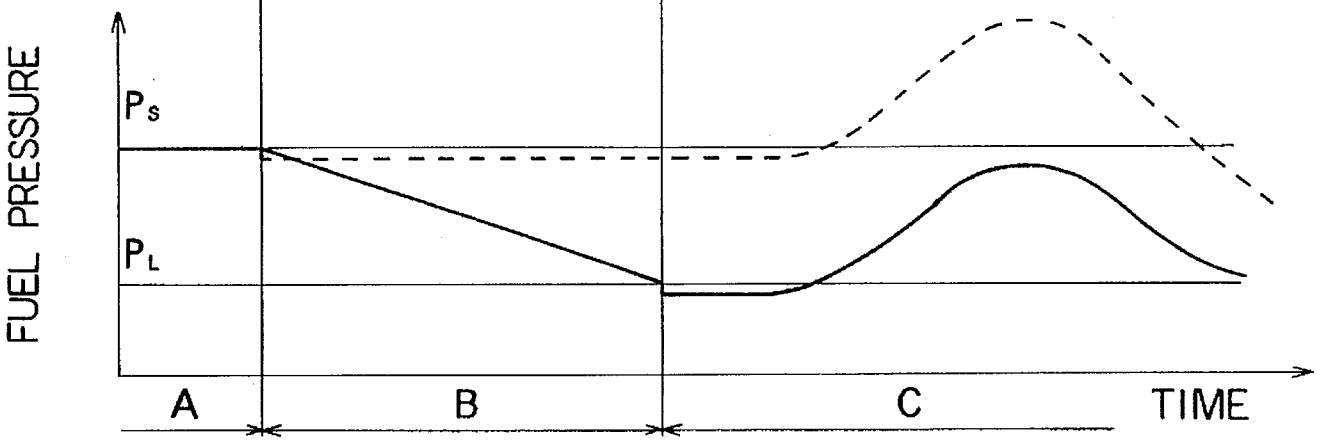

The broken line in FIG. 4B shows the situation when the voltage is not applied to fuel pump 1 simultaneously with an engine stop, wherein check valve 4 immediately closes due to counterflow of the fuel caused by rapid decrease of the discharged pressure. Thus, fuel pressure "Pf" in delivery pipe 2 exceeds the set value "Ps" and rises extremely.

In this embodiment, when fuel pump 1 is disposed at a slightly tilting position from the perpendicular position in fuel tank 7, sliding resistance of check valve 4 increases.. Therefore, even if a special machining is not performed to increase the sliding resistance between bar-shaped base 42 of check valve 4 and the inner periphery of through hole 181 of support member 18, check valve 4 can be kept open against a certain amount of the counterflow of the fuel.

Furthermore, check valve 4 may be made of a material having a smaller specific gravity than the fuel to prevent check valve 4 from moving downward even if the fuel counterflows by a certain amount. In addition, a spring member may be used to support check valve 4 at an open position.

According to the fuel supply apparatus of this embodiment, the conventional exterior-type manifold is not required, and further fuel pressure "Pf" in delivery pipe 2 can be prevented from rising excessively when the fuel injection stops, by employing a fuel pump substantially same as the conventional one with a minor change of the electric circuit in FP controller 5.

Although this embodiment where the internal combustion engine stops at the time of fuel injection stop is described, however, the same process may be performed when the fuel is cut off which is widely known as a method for preventing the fuel pressure from rising excessively. In this case, when the fuel is cut off, ECU 6 adjusts the high-level duty of an output pulse signal to zero.

A second embodiment of the present invention is hereinafter described with reference to the accompanying drawings.

Figure 5:
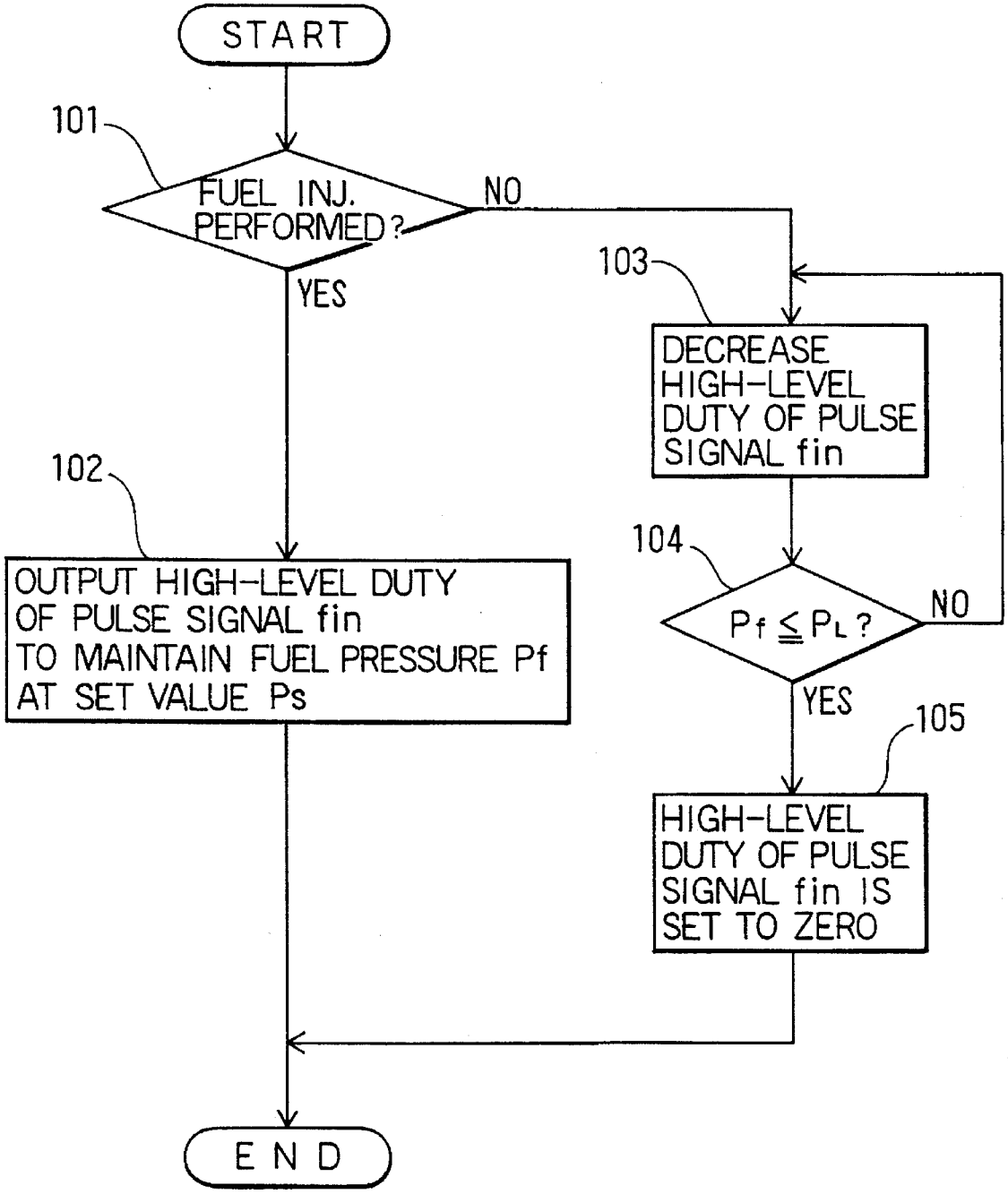
FIG. 5 is a flow chart showing processes executed by an ECU according to a second embodiment of the present invention.

According to the above-specified first embodiment, voltage applied to fuel pump 1 is controlled by peak hold circuit 52 and switch circuit 53, however, it may be controlled by a computer program of ECU 6, as shown in FIG. 5.

A step 101 in the flow chart judges whether the fuel injection is being performed or not. More specifically, it judges whether the engine is running based on a rotation pulse signal from the engine, or the fuel is not cut off based on a signal of an idle switch not shown (which turns on when a throttle valve not shown is fully closed) and revolution speed of the engine. When the engine is running and also the fuel is not cut off, it judges that the fuel injection is being performed and proceeds to a step 102.

To maintain fuel pressure "Pf" in delivery pipe 2 detected by pressure sensor 3 at set value "Ps", fuel pump 1 is rotated at a desired rotational speed by setting the high-level duty of output pulse signal fin at step 102.

When the fuel injection is not being performed at the step 101, the high-level duty of pulse signal "fin" is decreased at a constant rate so that the rotational speed of fuel pump 1 is slowly lowered at a step 103. When fuel pressure "Pf" in delivery pipe 2 reaches the lowest limit value "PL" at a step 104, the high-level duty of pulse signal "fin" becomes zero at a step 105 to stop fuel pump 1 at a step 105.

A third embodiment of the present invention is hereinafter described.

Figure 6:
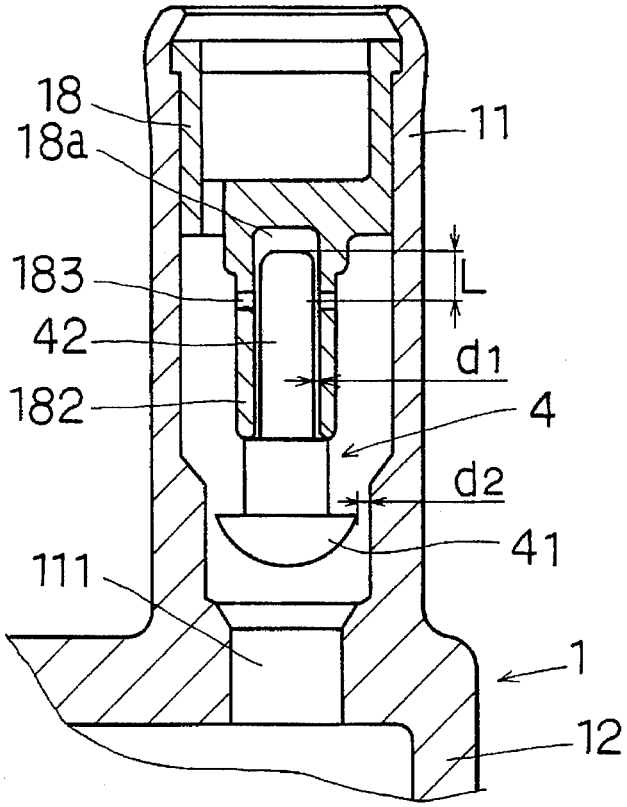
FIG. 6 is a cross-sectional view of a discharge pipe of a fuel pump according to a third embodiment of the present invention.

FIG. 6 shows a structure of a check valve 4 which needs a certain time to move downward when the fuel counterflows. By employing such a check valve 4, check valve 4 does not close for a while even if fuel pump 1 stops immediately when the fuel injection stops due to an engine stop or a cutoff of the fuel. The fuel pressure in delivery pipe 2 is reduced, thereby avoiding an excessive rise.

In FIG. 6, valve portion 41 of check valve 4 is located upward away from discharge opening 111 and is in a open position. A certain clearance "d1" is formed between the outer periphery of bar-shaped base 42 of check valve 4 and a cylindrical wall 182 of support member 18 where bar-shaped base 42 is inserted. Cylindrical wall 182 has plural through holes 183 at a position away from the top end of check valve 4 by a distance "L" when check valve 4 is opened.

When the fuel pump 1 stops with a stop of the fuel injection, the fuel counterflows from delivery pipe 2 to pump housing 12 at the bottom of the figure. A downward load is applied on valve portion 41 of check valve 4. While moving speed of check valve 4 is restricted by the amount of the fuel flowing from through holes 183 to a space 18*a* behind bar-shaped base 42 through a clearance "d1", discharge opening 111 is opened. Thus, the fuel in delivery pipe 2 returns to pump housing 12 through a clearance "d2" at the outer periphery of valve portion 41 of check valve 4, and the fuel pressure "Pf" in delivery pipe 2 is gradually reduced.

Figure 7:
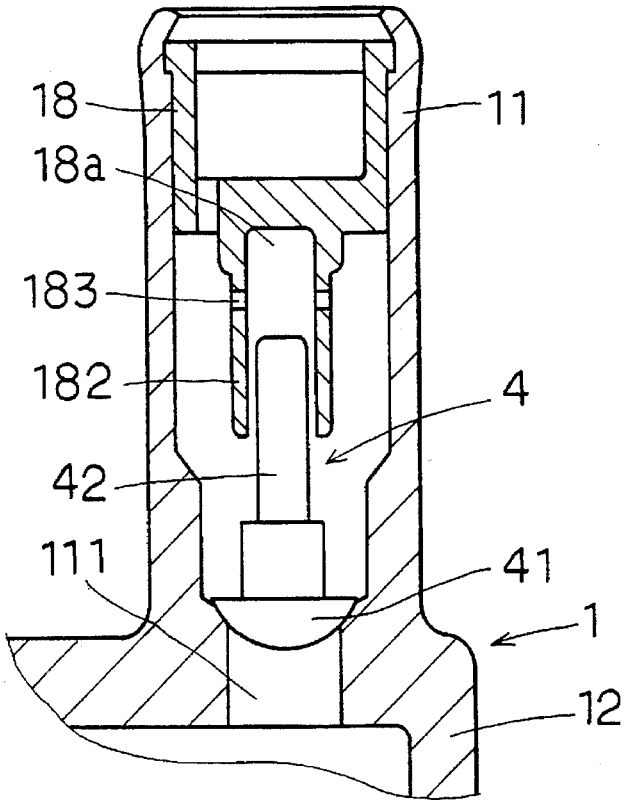
FIG. 7 is a cross-sectional view of the discharge pipe of the fuel pump according to the third embodiment of the present invention.

When bar-shaped base 42 of check valve 4 moving downward slowly passes by through holes 183, through holes 183 is largely opened so that the fuel flows into space 18*a* behind bar-shaped base 42, then check valve 4 moves downward rapidly to close discharge opening 111 (in FIG. 7).

Figure 8:
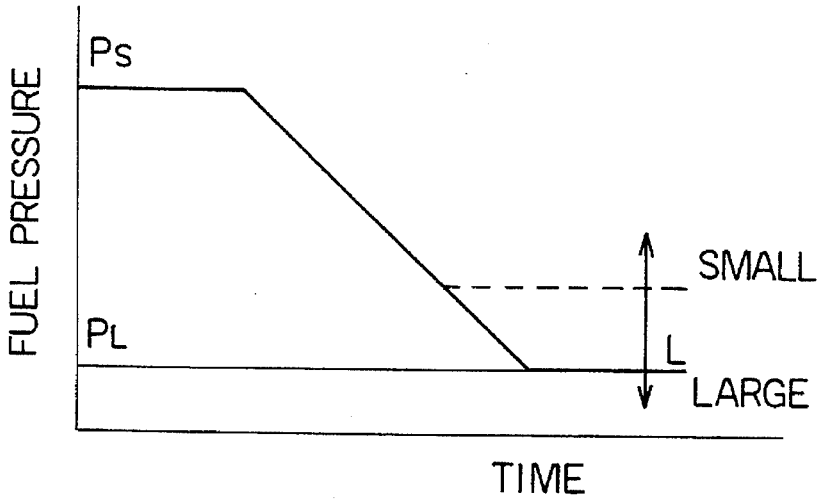
FIG. 8 is a graph showing a change of fuel pressure in a delivery pipe with respect to time according to the third embodiment of the present invention.

By such a movement of check valve 4, fuel pressure "Pf" in delivery pipe 2 decreasing from set value "Ps" to the lowest limit value "PL" at a fixed rate as shown in FIG. 8 can be controlled. The lowest limit value "PL" can be altered as shown with a broken line in accordance with a length of distance "L" (in FIG. 6) from the top end of check valve 4 to through holes 183 when check valve 4 is opened.

A fourth embodiment is hereinafter described.

Figure 9:
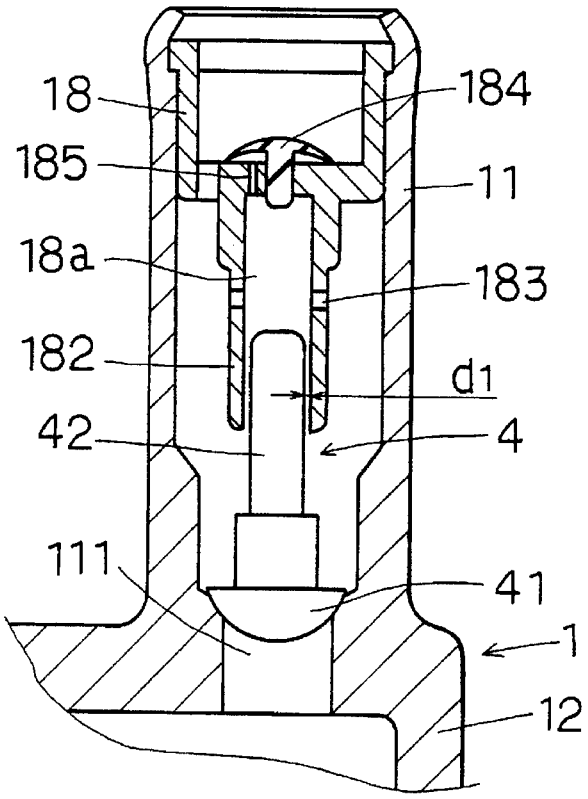
FIG. 9 is a cross-sectional view of a discharge pipe of a fuel pump according to a fourth embodiment of the present invention.
Figure 10:
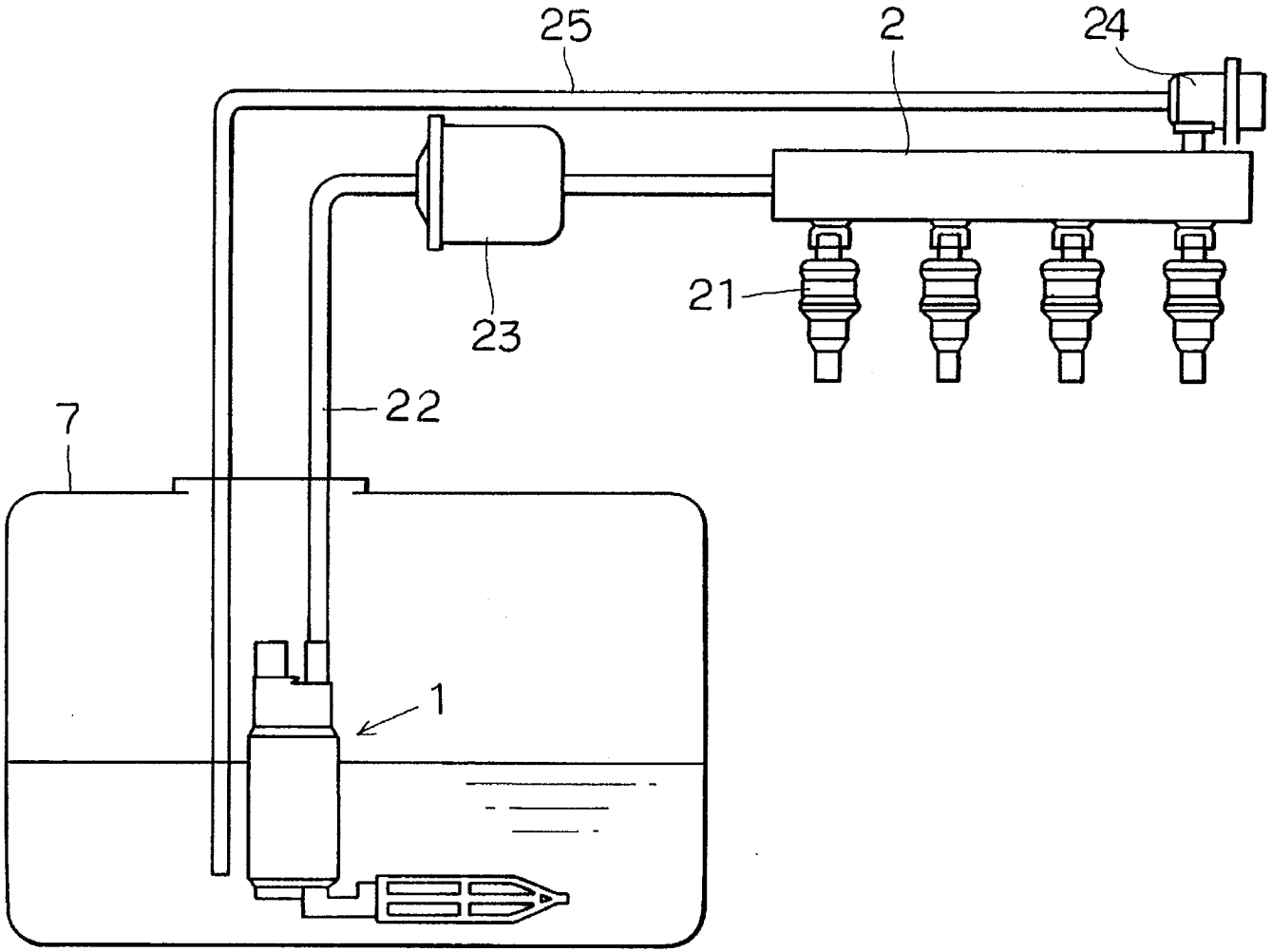
FIG. 10 PRIOR ART
FIG. 10 is a view of an entire structure of a conventional fuel supply apparatus.

In this embodiment, a structure for a rapid opening of check valve 4 is further added to the structure in the third embodiment. That is, as shown in FIG. 9, a fuel circulating hole 185 passing upward from space 18*a* behind bar-shaped base 42 of check valve 4 through support member 18 and a rubber-made umbrella valve 184 covering fuel circulating hole 185 from the top thereof are disposed. The thin umbrella portion of umbrella valve 184 located immediately above fuel circulating hole 185.

In the above-described structure, when discharge pressure accompanied with a start of fuel pump 1 is applied on valve portion 41 at the top of check valve 4, the thin umbrella portion of umbrella valve 184 deforms upward so that the fuel rapidly flows out of space 18*a* behind bar-shaped base 42 through fuel circulating hole 185 and check valve 4 quickly moves upward to be opened. At the time of a stop of fuel pump 1, the thin umbrella portion returns to its original shape to cover fuel circulating hole 185. As a result, check valve 4 moves downward at a fixed speed determined by clearance "d1" between bar-shaped base 42 and cylindrical wall 182 to close discharge opening 111 in the same manner as in the third embodiment.

The present invention can be employed only when a fuel temperature or an ambient temperature at a stop of fuel injection is high.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A fuel supply apparatus for supplying fuel to an internal combustion engine comprising:

a fuel injection valve for injecting fuel to be supplied to said internal combustion engine;

a fuel pump for discharging and supplying fuel with said fuel injection valve;

discharged fuel pressure control means for controlling a pressure of fuel from said fuel pump;

a check valve for preventing counterflow of fuel from said fuel injection valve; and pump control means for stopping said fuel pump after reducing pressure of said fuel pump gradually at a stop of the fuel supply to said internal combustion engine.

2. A fuel supply apparatus for an internal combustion engine according to claim 1, wherein said pump control means stops said fuel pump after said pressure of discharged fuel reaches a predetermined value.

3. A fuel supply apparatus for an internal combustion engine according to claim 1, wherein said pump control means reduces voltage applied to said fuel pump at a predetermined rate from a voltage value just before said internal combustion engine stops.

4. A fuel supply apparatus for an internal combustion engine according to claim 1, further comprising:

delay means for delaying a responsive movement of said check valve at said stop of the fuel supply.

5. A fuel supply apparatus for an internal combustion engine according to claim 4, wherein;

said check valve includes:

a housing having a passage therein, one end of said passage being a discharge opening which leads to said fuel injection valve;

a bar-shaped base disposed in said housing; and a valve portion connected to said bar-shaped base to open and close said discharge opening at said stop of the fuel supply.

6. A fuel supply apparatus for an internal combustion engine according to claim 5, wherein;

fuel pressure is applied to said check valve so as to close said discharge opening at said stop of the fuel supply.

7. A fuel supply apparatus for an internal combustion engine according to claim 5, wherein;

said delay means includes:

a cylindrical wall having a closed end, to which said bar-shaped base is inserted said outer periphery of said bar-shaped base so as to form a pressure chamber therebetween for accumulating fuel pressure to close said check valve;

restricting means for restricting fuel pressure from entering said pressure chamber at said stop of the fuel supply.

8. A fuel supply apparatus for an internal combustion engine according to claim 7, wherein said restricting means is defined by a clearance between an inner surface of said cylindrical wall and outer peripheral surface of said bar-shaped base.

9. A fuel supply apparatus for an internal combustion engine according to claim 8, wherein said cylindrical wall includes a through hole to release fuel pressure in said pressure chamber after said bar-shaped base moves slowly with a predetermined distance.

10. A fuel supply apparatus for an internal combustion engine according to claim 7, wherein;

said closed end of said cylindrical wall includes a fuel flow hole; and a valve member disposed in said fuel flow hole for allowing fuel flow out of only from said fuel flow hole.

11. A fuel supply apparatus for an internal combustion engine according to claim 1, wherein said check valve is disposed at a tilting position from a perpendicular position.

12. A fuel supply apparatus for supplying fuel to an internal combustion engine comprising:

a fuel injection valve for injecting fuel to be supplied to said internal combustion engine;

a fuel pump for discharging and supplying fuel with said fuel injection valve;

fuel pressure adjusting means for adjusting said pressure of fuel supplied to said fuel injection valve while a fuel supply is performed by said fuel injection valve;

a check valve for preventing counterflow of fuel from said fuel injection valve;

pressure reducing means for reducing the pressure of fuel discharged from said fuel pump gradually at a stop of the fuel supply to said internal combustion engine; and stop means for stopping said fuel pump after said pressure of fuel discharged from said is reduced to a predetermined value.

13. A fuel supply apparatus for an internal combustion engine according to claim 12, wherein said pump control means reduces voltage applied to said fuel pump at a predetermined rate from a voltage value just before said internal combustion engine stops.

14. A fuel supply apparatus for an internal combustion engine according to claim 12, further comprising:

delay means for delaying a responsive movement of said check valve at said stop of the fuel supply.

15. A fuel supply apparatus for an internal combustion engine according to claim 14, wherein;

said check valve includes:

a housing having a passage therein, one end of said passage being a discharge opening which leads to said fuel injection valve;

a bar-shaped base disposed in said housing; and a valve portion connected to said bar-shaped base to open and close said discharge opening at said stop of the fuel supply.

16. A fuel supply apparatus for supplying fuel to an internal combustion according to claim 15, wherein said check valve is opened while said pressure reducing means reduces said pressure of fuel discharged from said fuel pump gradually.

17. A fuel supply apparatus for supplying fuel to an internal combustion engine comprising:

a fuel injection valve for injecting fuel to be supplied to said internal combustion engine;

a fuel pump for discharging and supplying fuel with said fuel injection valve;

fuel pressure detecting means for detecting a pressure of fuel supplied to said fuel injection valve;

fuel pressure adjusting means for adjusting said pressure of fuel supplied to said fuel injection valve to a constant value while said fuel injection is performed by said fuel injection valve;

a check valve for preventing counterflow of fuel from said fuel injection valve;

pressure reducing means for reducing the pressure of fuel discharged from said fuel pump gradually at a stop of the fuel supply to said internal combustion engine; and stop means for stopping said fuel pump after said pressure of fuel discharged from said is reduced to a predetermined value.

18. A fuel supply apparatus for an internal combustion engine according to claim 17, wherein said pump control means reduces voltage applied to said fuel pump at a fixed rate from a voltage value just before said internal combustion engine stops.

19. A fuel supply apparatus for an internal combustion engine according to claim 17, further comprising:

delay means for delaying a responsive movement of said check valve at said stop of the fuel supply.

20. A fuel supply apparatus for an internal combustion engine according to claim 19, wherein;

said check valve includes:

a housing having a passage therein, one end of said passage being a discharge opening which leads to said fuel injection valve;

a bar-shaped base disposed in said housing; and a valve portion connected to said bar-shaped base to open and close said discharge opening at said stop of the fuel supply.

* * * * *